US007515841B2

(12) United States Patent
Kato et al.

(10) Patent No.: US 7,515,841 B2
(45) Date of Patent: Apr. 7, 2009

(54) IMAGE FORMING APPARATUS FOR PREVENTING DEFECTIVE FIXING OF A TONER IMAGE

(75) Inventors: Akira Kato, Mishima (JP); Akira Hayakawa, Mishima (JP); Kenichi Ogawa, Numazu (JP); Hisashi Nakahara, Numazu (JP); Shinsuke Kobayashi, Susono (JP); Yoshihiko Tanaka, Mishima (JP); Hironori Kato, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 258 days.

(21) Appl. No.: 11/538,743

(22) Filed: Oct. 4, 2006

(65) Prior Publication Data

US 2007/0086817 A1 Apr. 19, 2007

(30) Foreign Application Priority Data

Oct. 12, 2005 (JP) ..... 2005-297599

(51) Int. Cl.
*G03G 15/00* (2006.01)
*G03G 15/20* (2006.01)

(52) U.S. Cl. ..... 399/44; 399/68; 399/388; 399/396

(58) Field of Classification Search ..... 399/44, 399/68, 69, 388, 394, 396
See application file for complete search history.

(56) References Cited

U.S. PATENT DOCUMENTS 5,987,275 A 11/1999 Toyohara et al.
2005/0154562 A1 * 7/2005 Matsuura et al. ..... 702/185

FOREIGN PATENT DOCUMENTS

JP 06-064219 A 3/1994
JP 08-083016 A 3/1996
JP 08-152834 A 6/1996
JP 2001-290389 A 10/2001

* cited by examiner

*Primary Examiner*—Hoang Ngo
(74) *Attorney, Agent, or Firm*—Canon U.S.A., Inc., IP Division

(57) ABSTRACT

An image forming apparatus prevents defective fixing of a toner image from occurring and shortens a printout time for a first sheet by determining a start timing for conveying the recording medium to a transferring position of the toner image in accordance with a warm-up state of a fixing unit, a voltage state of a power supply, and an environmental temperature.

7 Claims, 17 Drawing Sheets

| |
|---|
| FIG. 5A |
| FIG. 5B |

FIG. 12

| DETECTION METHOD | 1) TH TEMPERATURE | 2) SCANNER ROTATION | 3) TH TEMPERATURE | STATUS | FIXABILITY (IN PAPER FEEDING AT TARGET TEMPERATURE −20 DEGREES) |
|---|---|---|---|---|---|
| TIMING | 500 msec | 1000 msec | 2000 msec | | |
| THRESHOLD | 45°C OR MORE | 98.3% OR MORE | 125°C OR MORE | 1 | − |
| | | | LESS THAN 125°C | 2 | ○ |
| | | LESS THAN 98.3% | 125°C OR MORE | 3 | ○ |
| | | | LESS THAN 125°C | 4 | △ |
| | LESS THAN 45°C | 98.3% OR MORE | 125°C OR MORE | 5 | ○ |
| | | | LESS THAN 125°C | 6 | △ |
| | | LESS THAN 98.3% | 125°C OR MORE | 7 | △ |
| | | | LESS THAN 125°C | 8 | × |

FIG. 13

| STATUS | CONDITION NUMBER IMPOSSIBLE TO FEED/CONVEY PAPER | PAPER-FEEDING/CONVEYING TIMING (DIFFERENCE RELATIVE TO TARGET TEMPERATURE) |
|---|---|---|
| 1 | 0 | − |
| 2 | 1 | −20 deg |
| 3 | 1 | −20 deg |
| 4 | 2 | −10 deg |
| 5 | 1 | −20 deg |
| 6 | 2 | −10 deg |
| 7 | 2 | −10 deg |
| 8 | 3 | ±0 deg |

| |
|---|
| FIG. 16A |
| FIG. 16B |

IMAGE FORMING APPARATUS FOR PREVENTING DEFECTIVE FIXING OF A TONER IMAGE

BACKGROUND OF THE INVENTION

1. Field of the Invention

The present invention relates to an image forming apparatus, such as a printer, a facsimile, a copier, or the like, using electrophotographic recording technique or electrostatic recording technique.

2. Description of the Related Art

The image forming apparatus that forms an image on a recording sheet using toner is required to reliably provide fixability of the toner on the recording sheet. However, there are various factors affecting the fixability of the toner. For example, the factors may be an environmental temperature (ambient temperature) of the location where the image forming apparatus is disposed, a voltage state of a power supply, and the like.

The reliable fixability is desired to be secured by taking into account such various factors affecting the fixability.

Meanwhile, considering the usability, the image forming apparatus in recent years is desired to shorten a printout time for a first recording sheet after a print command is given (first printout time, hereinafter, referred to as FPOT). Therefore, it is desired to reliably secure the fixability regardless of the factors affecting the fixability, and to shorten the FPOT.

Japanese Patent Laid-Open No. 6-64219 discloses that FPOT is shortened by starting paper feeding when a rotation speed of a scanning motor reaches a predetermined rotation speed which is less than a rotation speed for image scanning.

Japanese Patent Laid-Open No. 8-152834 discloses that FPOT is shortened by predicting a rising-completion timing of a fixing unit or a scanning motor, and starting the paper feeding before the completion of the rising.

Japanese Patent Laid-Open No. 8-83016 discloses that warming-up control is set in accordance with environmental indices, such as a voltage state of a power supply, an environmental temperature, and the like, affecting the fixability.

A fourth embodiment in Japanese Patent Laid-Open No. 2001-290389 discloses that a paper-feeding timing is determined in accordance with room-temperature information.

However, the configurations disclosed in Japanese Patent Laid-Open Nos. 6-64219 and 8-152834 do not take into account the factors, such as the environmental temperature, affecting the fixability. Therefore, defective fixing may occur. For example, even through the fixing unit is sufficiently warm since printing is just performed, the fixability may not be secured when a recording sheet is cold due to a low-temperature environment.

The configuration disclosed in Japanese Patent Laid-Open No. 8-83016 indicates that warming-up control is set in accordance with the environmental indices, and that the paper-feeding timing may be set after the warming-up is completed in any environmental index.

The configuration disclosed in Japanese Patent Laid-Open No. 2001-290389 only takes into account the room temperature, and does not consider other factors affecting the fixability.

SUMMARY OF THE INVENTION

To address the above-described problems, the present invention provides an image forming apparatus capable of preventing defective fixing from occurring, and of shortening a printout time for a first sheet.

According to an aspect of the present invention, an image forming apparatus includes: a photosensitive member; a laser scanner that scans the photosensitive member with laser beam in accordance with image information, the laser scanner having a motor to which a rotating mirror that deflects the laser beam is attached; a transferring unit that transfers a toner image formed on the photosensitive member on a recording medium at a transferring position; a fixing unit that heats and fixes the toner image transferred on the recording medium; and a conveyance controller that controls conveyance of the recording medium, in which the conveyance controller determines a start timing for conveying the recording medium to the transferring position in accordance with a warm-up state of the fixing unit, a voltage state of a power supply, and an environmental temperature, at a time when the toner image is started to be formed on the photosensitive member.

According to another aspect of the present invention, a method for determining a start timing for conveying a recording medium to a transferring position where a toner image formed on a photosensitive member is transferred on the recording medium, includes: determining a warm-up state of a fixing unit for fixing the toner image on the recording medium at a time when the toner image is started to be formed on the photosensitive member; determining a voltage state of a power supply for supplying an electric energy to the fixing unit at a time when the toner image is started to be formed on the photosensitive member; determining an environmental temperature at a time when the toner image is started to be formed on the photosensitive member; determining a start timing for conveying the recording medium to the transferring position based on the warm-up state of the fixing unit, the voltage state of the power supply, and the environmental temperature.

Further features of the present invention will become apparent from the following description of exemplary embodiments with reference to the attached drawings.

BRIEF DESCRIPTION OF THE DRAWINGS

FIG. 12 is a table organizing printer statuses when printing is started, the statuses being able to be determined by monitoring the temperature of the heater and the rotation speed of the scanning motor.

FIG. 13 is a table organizing the relationship between the printer statuses when the printing is started and paper-feeding-start timings.

DESCRIPTION OF THE EMBODIMENTS

First Embodiment

Figure 1:
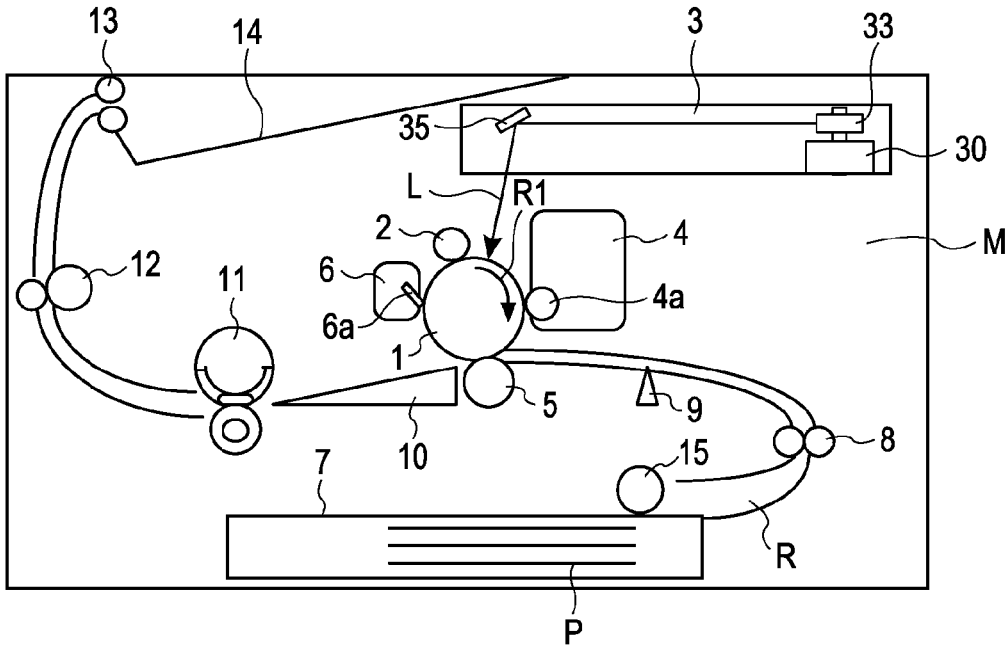
FIG. 1 is a schematic cross sectional view showing an exemplary laser beam printer to which embodiments of the present invention can be applied.

FIG. 1 is a schematic cross sectional view showing a laser beam printer according to a first embodiment of the present invention.

In the same drawing, reference numeral 1 denotes a drum-type electrophotographic photosensitive member (hereinafter, referred to as a photoconductor drum) which is an image carrier. The photoconductor drum 1 is rotatably supported by an apparatus body M, and is rotated at a predetermined process speed in an arrow R1 direction by a driving unit (not shown). A charging device (charging roller) 2, an exposure device (scanning unit, laser scanner) 3, a developing device 4, a transferring unit 5, and a cleaning device 6 are disposed around the photoconductor drum 1, sequentially along a rotation direction of the photoconductor drum 1. The photoconductor drum 1, the charging device 2, the developing device 4 and the cleaning device 6 may form a unit as a cartridge which is detachably attached to the apparatus body M.

In the same drawing, a paper cassette 7 is disposed at a lower portion of the apparatus body M, and a sheet-like recording medium P, such as a sheet of paper, is housed in the paper cassette 7. The recording medium P is conveyed along a conveying path R, sequentially from the upstream side to a paper-feeding unit 15, a conveying roller 8, a top sensor 9, the transferring unit 5, a sheet-metal conveying guide 10, a fixing unit 11, a conveying roller 12, and then to a paper-discharging roller 13. The paper-feeding unit 15 includes a paper-feeding roller 18 (shown in FIG. 4) driven by a main motor 16 (shown in FIG. 4) of the apparatus body M, and a solenoid 17 (shown in FIG. 4) that switches power transmission between the main motor 16 and the paper-feeding roller 18. The main motor 16 also drives the photoconductor drum 1, a developing roller 4*a*, the conveying roller 8, and the like.

Figure 2:
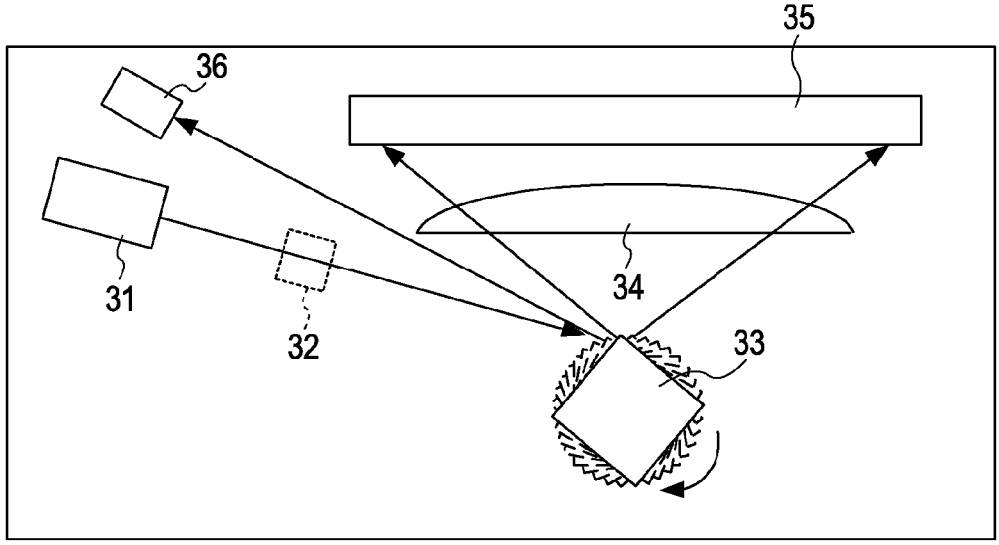
FIG. 2 is a schematic illustration of an exemplary scanning unit to which embodiments of the present invention can be applied.

FIG. 2 is a schematic illustration showing the scanning unit 3 according to an embodiment of the present invention. As shown in FIGS. 1 and 2, a light source 31 that emits laser light modulated in accordance with image information, a collimator lens 32 that parallelizes the laser light emitted from the light source 31, and a rotating polygon mirror (rotating mirror) 33 that deflects the laser light, are disposed in an optical box of the scanning unit 3. In addition, a motor 30 (hereinafter, referred to as a scanning motor) to which the rotating polygon mirror 33 is attached, an fθ lens 34 (hereinafter, referred to as a scanning lens), a reflecting mirror 35, and the like, are disposed. The laser light in accordance with the image information is reflected by the reflecting mirror 35, and then emitted on the photoconductor drum 1.

As shown in FIG. 2, a part of scanning beam is optically detected by a photodetector 36. A light-emitting-start timing of the laser light is controlled in accordance with an output of the photodetector 36 to prevent positional deviation of image writing in a main scanning direction. In addition, the photodetector 36 outputs pulse signals proportional to a rotation speed of the scanning motor 30, and an interval of the pulse signals may determine a rotation state of the scanning motor 30.

A bearing of the scanning motor 30 is a dynamic pressure fluid bearing. As the fluid, oil is used (oil-based bearing). The viscosity of the oil used for the oil-based bearing is temperature-dependent. The oil is filled in a gap between a scanning motor shaft and a bearing blanket, and the scanning motor shaft is not in contact with the bearing blanket during rotation.

Next, an image forming operation of the printer according to the present embodiment will be described.

When the image forming operation is started, the photoconductor drum 1 rotated in the arrow R1 direction by the driving unit is evenly charged at a predetermined polarity and at a predetermined electric potential by the charging roller 2.

The photoconductor drum 1 with the surface thereof charged is scanned by the above-described scanning unit 3 with laser light L in accordance with the image information. Accordingly, electric charge at an exposed part on the photoconductor drum 1 is removed to form an electrostatic latent image.

Then, the electrostatic latent image is developed by the developing device 4 to form a toner image on the photoconductor drum 1. Note that the developing device 4 includes the developing roller 4*a*, and a developing bias is applied to the developing roller 4*a*, so that toner is adhered to the electrostatic latent image on the photoconductor drum 1. Accordingly, the toner image is formed on the photoconductor drum 1.

Meantime, a recording medium P housed in the paper cassette 7 is conveyed along with the above-described toner-image-forming operation. The recording medium P housed in the paper cassette 7 is fed by the paper-feeding unit 15, conveyed by the conveying roller 8, passes through the top sensor 9, and then is conveyed to a transfer nip portion (transferring position) between the photoconductor drum 1 and a transfer roller 50 which is provided at the transferring unit 5.

At this time, the top sensor 9 detects an end of the recording medium P so that the paper feeding is synchronized with the toner image on the photoconductor drum 1. Accordingly, as the recording medium P is conveyed to the transfer nip portion, the toner image on the photoconductor drum 1 is transferred on a predetermined position of the recording medium P by a transfer bias which is applied to the transfer roller 50.

The recording medium P that carries the unfixed toner image is conveyed along the conveying guide 10 to a fixing nip portion in the fixing unit 11, and the toner image is heated and fixed on the recording medium P. Then, the recording medium P is discharged on a paper-discharging tray 14 which is provided at an upper surface of the apparatus body M by way of the conveying roller 12 and the paper-discharging roller 13.

Meantime, the photoconductor drum 1 after the toner image is transferred is cleaned by a cleaning blade 6*a* of the cleaning device 6, and prepared for a next image forming operation. By repeating the above-described operation, images can be formed one after another.

Figure 3:
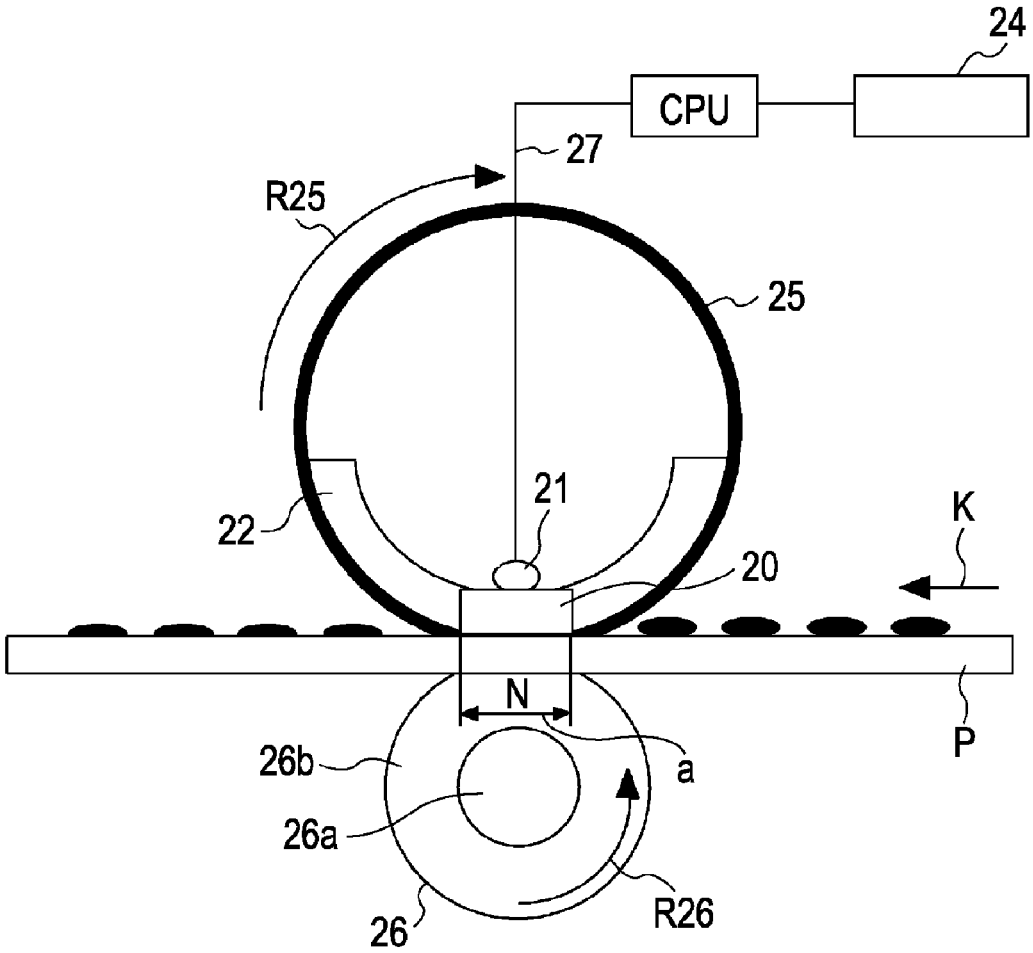
FIG. 3 is a cross sectional view showing an exemplary fixing unit to which embodiments of the present invention can be applied.

Next, the fixing unit 11 mounted on the image forming apparatus according to the present embodiment will be described in detail with reference to FIG. 3. This drawing is a vertical cross sectional view along a conveying direction (arrow K direction) of the recording medium P.

The fixing unit 11 shown in the same drawing includes a ceramic heater 20 as a heater for heating toner, a fixing film (flexible member) 25 with the heater 20 disposed inside, and a pressing roller 26 that forms a fixing nip portion N with the heater 20 with the fixing film 25 being interposed therebetween. In addition, a thermistor (temperature-detecting element) 21 for detecting the temperature of the heater 20 is provided at the back surface of the heater 20. The pressing roller 26 is driven by a fixing motor 29 (shown in FIG. 4).

The heater 20 is held by a heater-holding member 22 (hereinafter, referred to as a heater holder) that is attached to the apparatus body M. The heater holder 22 is made of heatproof resin, and its cross section is semicircular. The heater holder 22 also guides rotation of the fixing film 25.

The fixing film 25 is made of heatproof resin, such as polyimide, and is formed in a cylindrical shape. The fixing film 25 rotates around the above-described heater 20 and the heater holder 22. The fixing film 25 is pressed to the heater 20 by the below-describing pressing roller 26, and the inner peripheral surface of the fixing film 25 is in contact with the lower surface of the heater 20. The fixing film 25 is rotated in an arrow R25 direction by rotation of the pressing roller 26 in an arrow R26 direction. Incidentally, flange portions (not shown) provided at the heater holder 22 are oppositely arranged on both end surfaces in a longitudinal direction (direction orthogonal to a paper surface of FIG. 3) of the fixing film 25, and the flange portions restrains movement of the fixing film 25 in the longitudinal direction.

The pressing roller 26 is so formed that an elastic layer 26*b*, such as silicone rubber, is provided on the outer peripheral surface of a cored bar 26*a* made of metal.

The thermistor 21 is in contact with the back surface of the heater 20. A CPU (temperature control unit) controls a triac 24 on the basis of a temperature detected by the thermistor 21 to control power application to the heater 20. The temperature control unit controls the triac 24 such that the detected temperature of the thermistor 21 holds a predetermined temperature.

As described above, in the fixing unit 11, while the rotation of the pressing roller 26 in the arrow R26 direction nips and conveys the recording medium P at the fixing nip portion N, the heater 20 applies heat to the toner on the recording medium P. At this time, the control of the rotation of the pressing roller 26 may appropriately control a conveying speed of the recording medium P, and the temperature control unit may appropriately control the temperature of the heater 20. In addition, the fixing unit 11 according to the present embodiment starts power application to the heater 20 after a print start signal is input. Since electric power is not applied to the heater 20 in a standby state for waiting the inputting of the print start signal, power consumption is extremely small.

Figure 4:
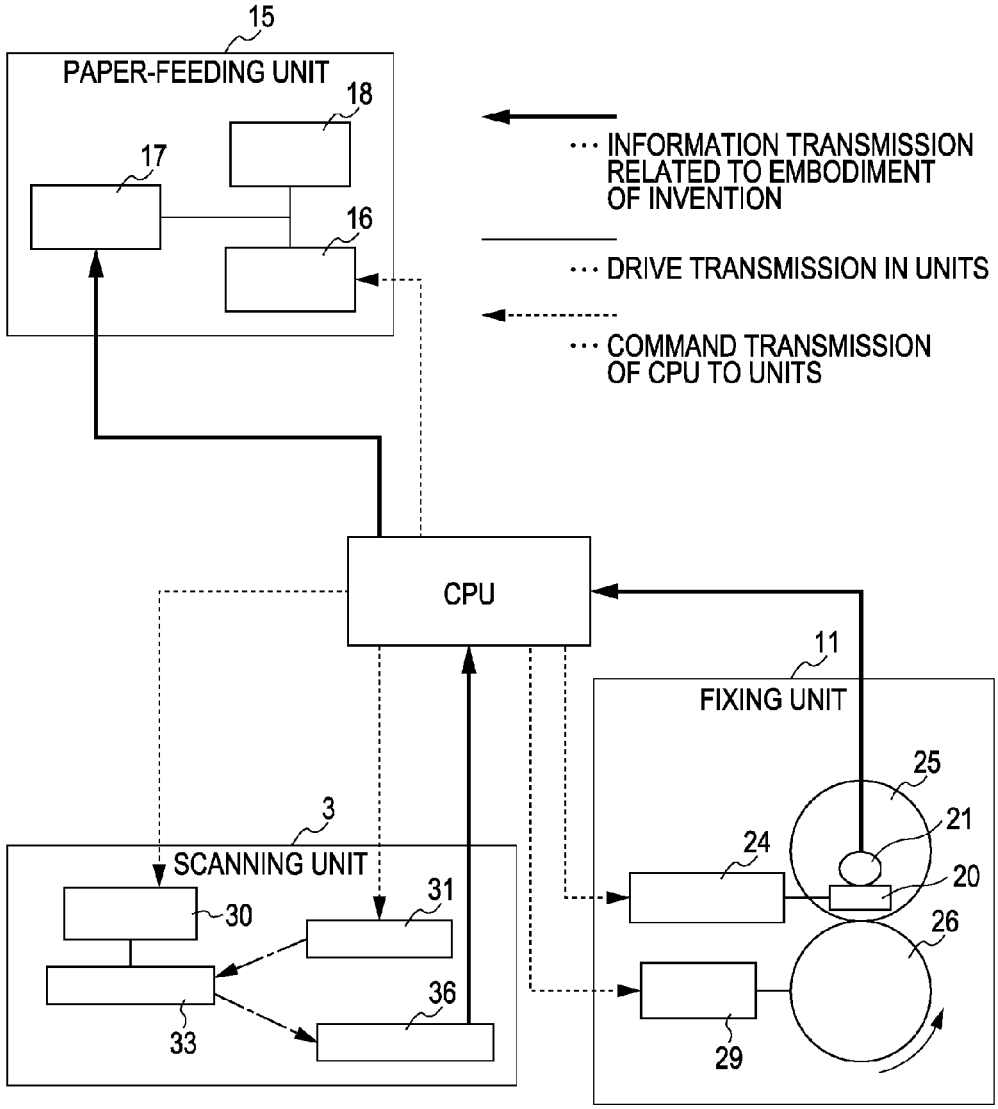
FIG. 4 is a block diagram showing the relationship among a paper-feeding unit, the scanning unit, and the fixing unit of an image forming apparatus according to a first embodiment.

FIG. 4 is a block diagram showing the relationship among the paper-feeding unit 15, the scanning unit 3, and the fixing unit 11, centering on the CPU (including the conveyance controller) of the image forming apparatus according to the present embodiment.

In FIG. 4, arrows indicate an information transmission system which transmits temperature information of the fixing unit 11 and rotation speed information of the scanning motor 30 to the CPU, and a command transmission system which transmits a command from the CPU to the solenoid 17 of the paper-feeding unit 15. These transmission systems are main features of the present embodiment. Solid lines shown in FIG. 4 indicate drive transmission in the scanning unit 3, the fixing unit 11, and the paper-feeding unit 15. Broken lines indicate a command transmission system between the CPU and each of the units.

Next, a method for determining a start timing for conveying the recording medium (paper-feeding timing) for the printer according to the present embodiment will be described. The printer of the present embodiment determines an environmental temperature (ambient temperature) at which the printer is disposed on the basis of an increase transition of the rotation speed of the scanning motor 30, a warm-up state of the fixing unit 11 and a voltage state of a power supply on the basis of an increase transition of the temperature of the heater 20. The start timing for conveying the recording medium is determined according to the three conditions.

First, rising characteristics of the scanning motor 30 of the oil-based bearing mounted on the printer according to the present embodiment will be described with reference to FIG. 7. The vertical axis indicates a proportion (%) of a detected rotation speed relative to a target rotation speed, and the horizontal axis indicates a time (sec). This graph shows an increase transition of the rotation speed of the scanning motor 30 when the power application to the scanning motor 30 is started while the temperature thereof is equilibrated at the environmental temperature (ambient temperature) at which the printer is disposed.

Figure 7:
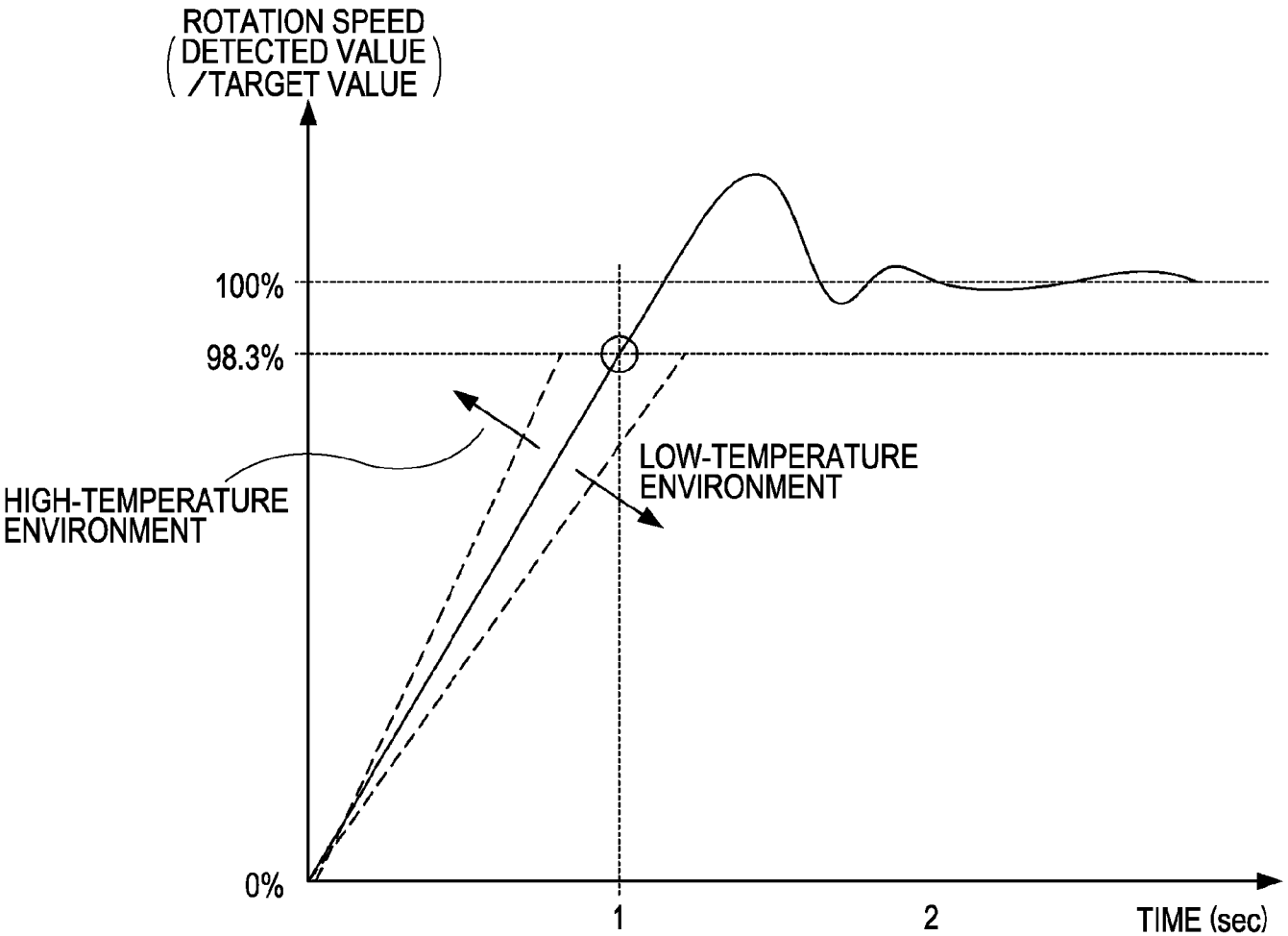
FIG. 7 is an explanatory illustration showing rising characteristics of a scanning motor of an oil-based bearing.

As shown in FIG. 7, when the ambient air is normal-temperature environment (23° C.), the rotation speed of the scanning motor 30 mounted on the printer according to the present embodiment increases to 98.3% of the target rotation speed (100%) for scanning in accordance with image information when about 1 second elapses after the power application to the scanning motor 30 is started. The rotation speed of the scanning motor 30 is slightly overshot, and then settled at the target rotation speed.

The viscosity of the oil increases in low-temperature environment, so that the rising speed of the scanning motor 30 decreases as compared with that in the normal-temperature environment. In contrast, the viscosity of the oil decreases in high-temperature environment, the rising speed of the scanning motor 30 increases as compared with that in the normal-temperature environment.

In addition, referring to FIG. 7, more the rotation speed of the scanning motor 30 approaches the target rotation speed, larger the difference between the line of the high-temperature environment and that of the low-temperature environment. Accordingly, the environmental temperature can be determined to a certain degree by the rotation speed of the scanning motor 30 when, for instance, 1 second elapses after the scanning motor 30 is activated.

Figure 8:
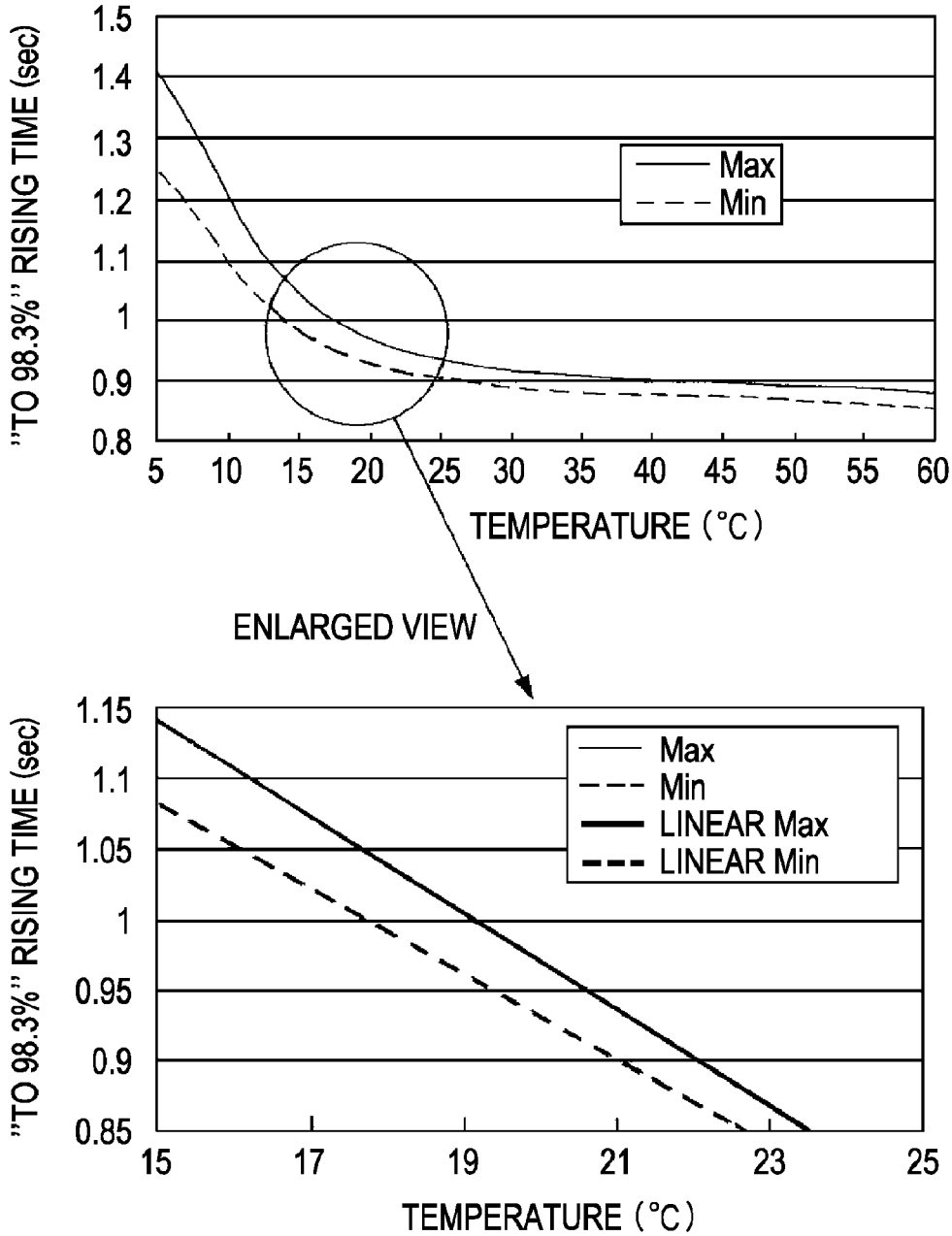
FIG. 8 is an illustration showing the relationship between an ambient temperature of the scanning motor and a time (rising time) necessary for raising a rotation speed of the scanning motor to 98.3% of a target rotation speed (100%) for laser beam scanning.

Next, FIG. 8 shows the relationship between an ambient temperature of the scanning motor 30 and a time (rising time) necessary for raising the rotation speed of the scanning motor 30 to 98.3% of the target rotation speed (100%) for laser beam scanning. The vertical axis indicates a time (sec) necessary for raising the rotation speed of the scanning motor 30 to 98.3% of the target rotation speed, and the horizontal axis indicates an environmental temperature. It should be noted that since there are some individual differences in the rising characteristics of the scanning motor 30, the longest rising time (line indicated as Max) and the shortest rising time (line indicated as Min) are selected from rising times of a plurality of samples and shown in FIG. 8. In addition, in an enlarged view shown in FIG. 8, the Max and Min lines in a circled portion are linearized.

As shown in FIG. 8, the Max and Min lines exhibit almost no variation in the rising time in a region extending from the normal-temperature (23° C.) environment to the high-temperature (60° C.) environment. However, the Max and Min lines exhibit rapid increase in the rising time in the low-temperature (temperature less than 23° C.) environment. While the rising characteristics of the scanning motor 30 may vary depending on the individual difference of the scanning motor 30 as described above, the rising time may vary in the environment at 15° C. and in the environment at 23° C. regardless of the individual difference as shown in the enlarged view shown in FIG. 8.

Namely, as shown in FIGS. 7 and 8, when the rising state of the scanning motor 30 is measured, the environmental temperature can be determined to a certain degree. In particular, the rotation speed of the scanning motor 30 is monitored when a certain amount of time elapses after the power application to the scanning motor 30 is started as shown in FIG. 7. For example, in the case of the scanning motor 30 according to the present embodiment, it is monitored whether the rotation speed of the scanning motor 30 reaches 98.3% of the target rotation speed when 1 second elapses after the power application to the scanning motor 30 is started. The monitoring in this way may accurately expect the degree of the environmental temperature.

Figure 9:
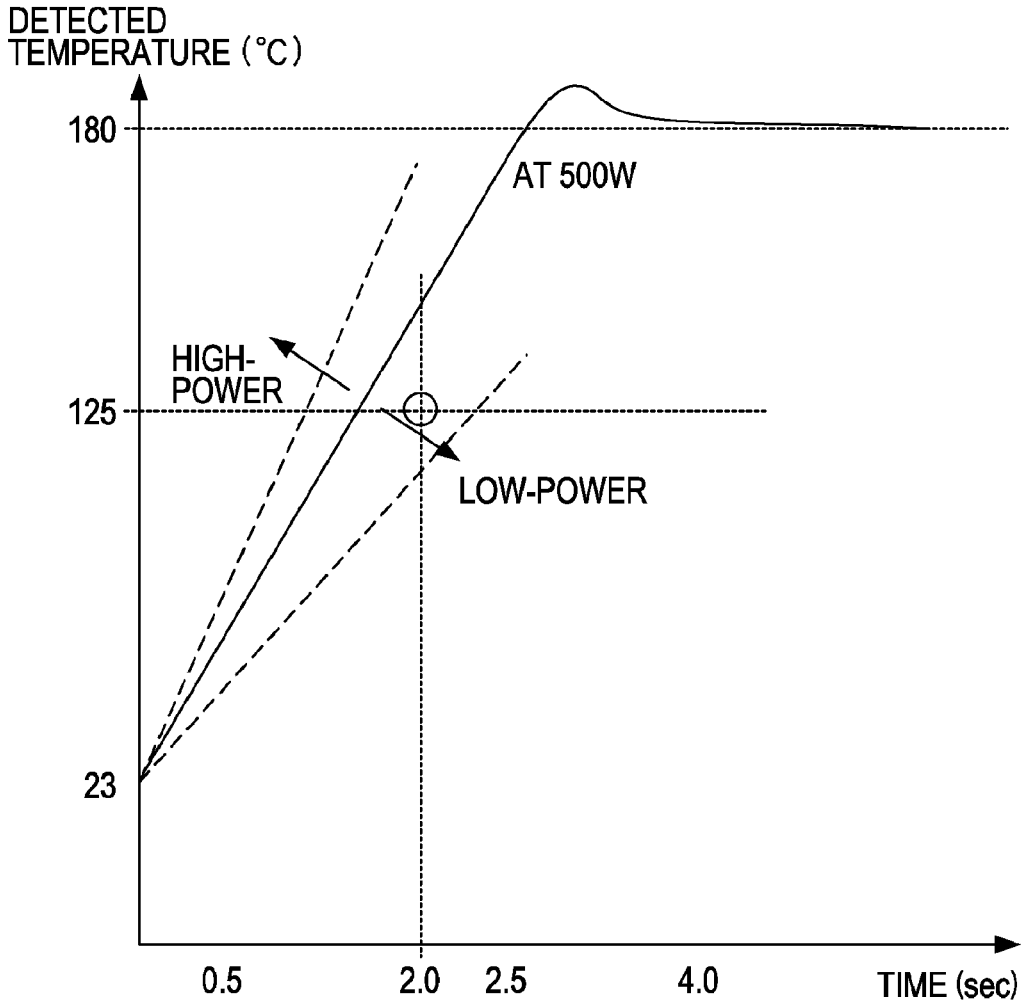
FIG. 9 is an illustration showing rising characteristics of the fixing unit (when a target temperature is set to 180° C. as a target temperature for fixing a toner image).

Next, FIG. 9 shows the rising characteristics of the fixing unit 11 (when a target temperature is set to 180° C. as a target temperature for fixing a toner image) according to the present embodiment. This graph shows an increase transition of the temperature of the heater 20 when the power application is started to the heater 20 while the temperature thereof is equilibrated at an environmental temperature (in this case, 23° C.). Note that this graph is obtained by monitoring a detected temperature of the thermistor 21 being in contact with the ceramic heater 20.

As shown in FIG. 9, since electric power applied to the fixing unit 11 varies due to deviation in voltage of commercial power supply applied to the printer, a temperature-increasing speed of the heater 20 becomes faster if the power application is based on higher-power, and the temperature-increasing speed becomes slower if the power application is based on lower-power, regardless of the environmental temperature when the power application to the heater 20 is started. In addition, more the time elapses after the power application is started, larger the variation of the temperature of the heater 20 due to the difference of the voltage of the power supply.

That is, the voltage of the power supply can be determined to a certain degree if the rising state of the temperature of the fixing unit 11 is measured. In particular, if the temperature of the heater 20 is monitored when a certain amount of time elapses after the power application to the heater 20 is started (e.g., if it is monitored whether the temperature of the heater 20 reaches 125° C. when 2 seconds elapse after the power application is started), the degree of the voltage of the power supply can be expected more accurately.

As already explained with reference to FIGS. 7 and 8, if the increase transition of the rotation speed of the scanning motor 30 is detected, the environment surrounding the printer can be determined to a certain degree. However, the warm-up state of the fixing unit 11 when the print is started may not be determined only by detecting the increase transition of the rotation speed of the scanning motor 30. For example, in a case where the fixing unit 11 is still sufficiently warm because a time period elapses after the previous printing is completed is short, even if the environmental temperature is low, the fixability is possibly secured by paper feeding at an early timing. In this case, FPOT will increase if a paper-feeding timing is determined only by two conditions of the environmental temperature according to the detection of the increase transition of the rotation speed of the scanning motor 30, and the voltage of the power supply. This is not desirable.

Therefore, the present embodiment also includes the warm-up state of the fixing unit 11 when the printing is started, as one of the conditions for determining the paper-feeding timing.

Figure 10A:
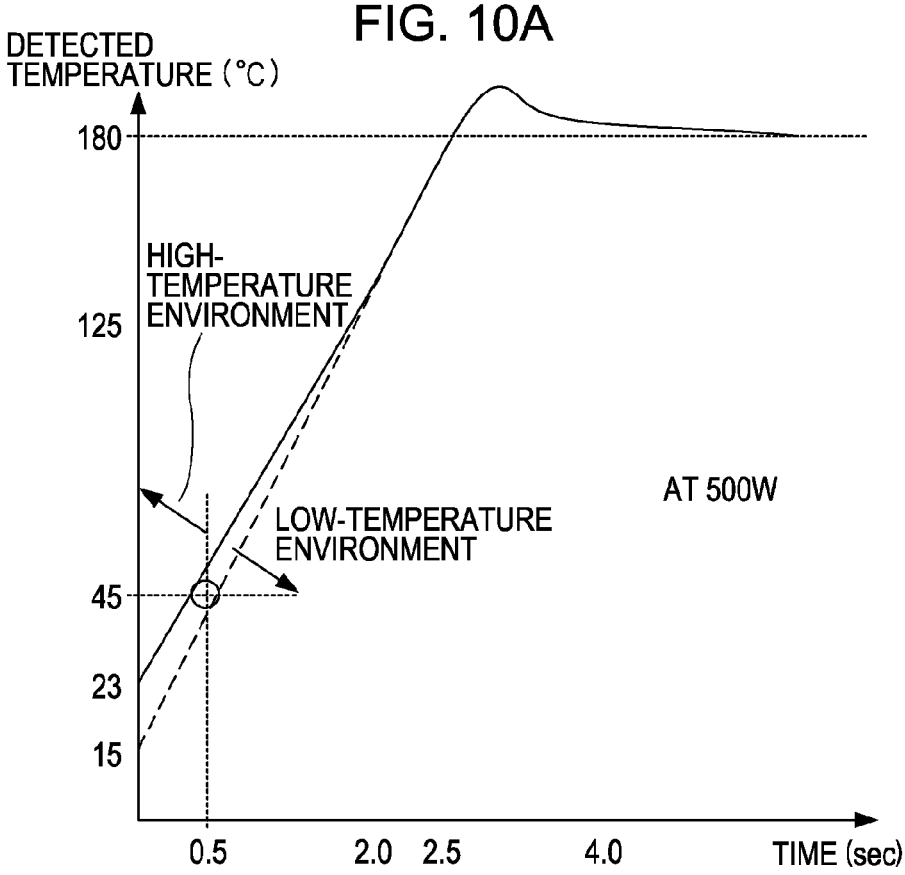
FIG. 10A is an illustration showing the rising characteristics of the fixing unit with respect to a warm-up state of the fixing unit.

FIG. 10A shows the rising characteristics of the fixing unit 11 with respect to the warm-up state of the fixing unit 11. Note that this graph is obtained, when the power application is at 500 W, by monitoring a detected temperature of the thermistor 21 being in contact with the ceramic heater 20. A solid line in FIG. 10A indicates a case where power application to the heater 20 is started while the printer is left in the environment at 23° C. for a long time, and the temperature of the fixing unit 11 is 23° C. when the power application is started. A broken line in FIG. 10A indicates a case where power application to the heater 20 is started while the printer is left in the environment at 15° C. for a long time, and the temperature of the fixing unit 11 is 15° C. when the power application is started.

As shown in FIG. 1A, the difference between the solid line and the broken line (variation of the detected temperatures) becomes small as the lines come close to a fixing target temperature (180° C.), however, in a case of the temperature of the fixing unit 11 (temperature of the heater 20) when the power application to the heater 20 is started, there is a difference between the solid line and the broken line.

Figure 10B:
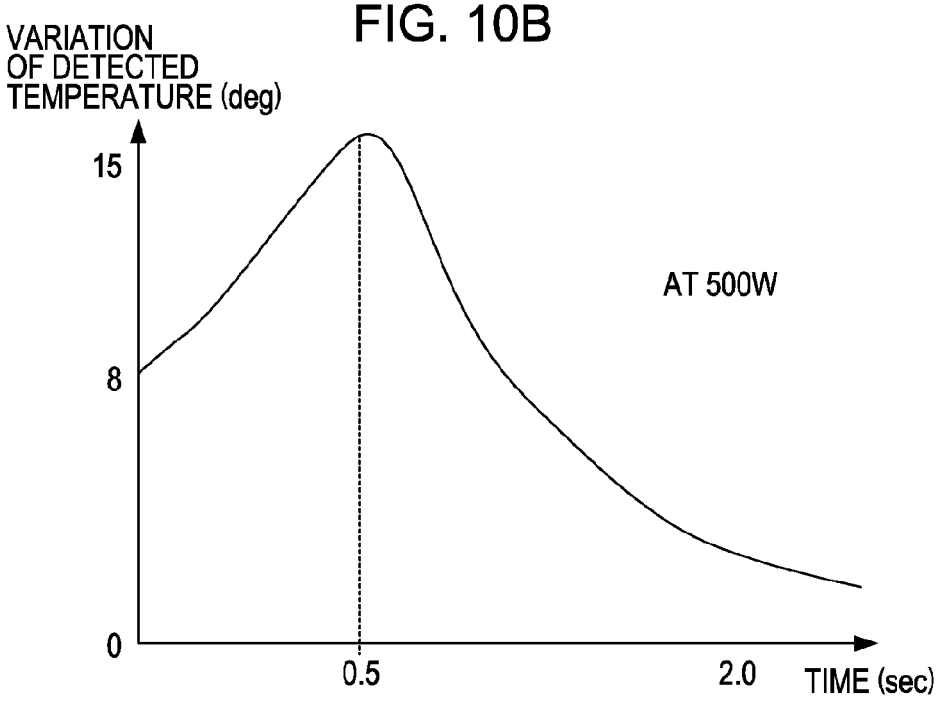
FIG. 10B is an illustration showing a transition of a variation between a detected temperature of a thermistor in a case where electric power at 500 W is applied to a heater while a temperature of the heater is equilibrated at 15° C., and a detected temperature of the thermistor in a case where the electric power at 500 W is applied to the heater while a temperature of the heater is equilibrated at 23° C.

In addition, FIG. 10B shows a transition of a variation between a detected temperature of the thermistor 21 in a case where electric power at 500 W is applied to the heater 20 while a temperature of the heater 20 is equilibrated at 15° C., and a detected temperature of the thermistor 21 in a case where the electric power at 500 W is applied to the heater while a temperature of the heater 20 is equilibrated at 23° C. As shown in this graph, the variation of the detected temperatures is the largest when 0.5 seconds elapse. In the fixing unit 11 of the present embodiment, a diameter of the fixing film 25 and that of the pressing roller 26 are both ϕ18 mm, and rotation of both rotating bodies is started substantially at the same time as that power application is started to the heater 20. In addition, the process speed is set to 115 mm/sec. Therefore, the timing of 0.5 seconds elapse corresponds to a timing immediately before the pressing roller 26 (or the fixing film 25) rotates substantially one turn after it starts rotating. That is, the peak of the variation of the detected temperatures appears immediately before both rotating bodies 25 and 26 rotate one turn after the rotation is started.

If the fixing unit 11 is warm enough when the printing is started, an amount of heat absorbed to the fixing film 25 and the pressing roller 26 until the fixing film 25 and the pressing roller 26 rotates one turn is small, so that the temperature of the heater 20 rapidly increases. However, if the fixing unit 11 is cold when the printing is started, an amount of heat absorbed to the fixing film 25 and the pressing roller 26 until the fixing film 25 and the pressing roller 26 rotate one turn becomes large, so that the temperature of the heater 20 slowly increases. Therefore, the peak of the variation of the detected temperatures appears immediately before the fixing film 25 and the pressing roller 26 rotate one turn after the rotation is started. Once the fixing film 25 rotates one turn, the fixing film 25 and the pressing roller 26 are heated to a certain degree, the difference between the solid line and the broken line becomes small. Since the outer diameters of the fixing film 25 and the pressing roller 26, and the process speed, are changed, the variation of the detected temperatures may largely appears at the timing in which the fixing film 25 rotates substantially one turn after it starts rotating. Therefore, if the detected temperature of the thermistor 21 is monitored at the timing immediately before the fixing film 25 rotates substantially one turn after the both rotating bodies start rotating, the warm-up state of the fixing unit 11 may be easily determined.

That is, referring to FIG. 10A, the warm-up state of the fixing unit 11 can be determined to a certain degree when the temperature state of the fixing unit 11 immediately after it starts rotating is measured. In particular, as shown in FIG. 10B, if the temperature of the heater 20 is monitored immediately after the power application to the heater 20 is started (e.g., in the case of the fixing unit 11 according to the present embodiment, if it is monitored whether the temperature of the heater 20 reaches 45° C. when 0.5 seconds elapse after the power application is started), the degree of the warm-up state of the fixing unit 11 can be expected more accurately.

As described above, 1: measuring the rising state of the scanning motor 30 allows the environmental temperature to be determined to a certain degree. 2: monitoring the temperature of the heater 20 when a certain amount of time elapses after the power application to the heater 20 is started allows the voltage of the power supply to be determined to a certain degree. 3: monitoring the temperature of the heater 20 immediately after the power application to the heater 20 is started allows the warm-up state of the fixing unit 11 when the printing is started, to be determined to a certain degree.

Incidentally, the scanning motor 30 according to the present embodiment becomes the same temperature as the environmental temperature when about 4 minutes elapse after the rotation is stopped. Therefore, when next printing is started when about 4 minutes elapse after previous printing is completed, the environmental temperature can be determined accurately. However, when the next printing is started and when less than 4 minutes has elapsed since the completion of the previous printing, the rotation speed of the scanning motor 30, when 1 second elapses after the scanning motor 30 is activated, becomes 98.3% or more. Accordingly, when the next printing is started and when less than 4 minutes has elapsed since the completion of the previous printing, the fixing unit 11, and in particular, the pressing roller 26 are still sufficiently warm, so that almost no defective fixing occurs. Hence, in such a case, the detected result of the rotation speed of the scanning motor 30 may be ignored.

Figure 11:
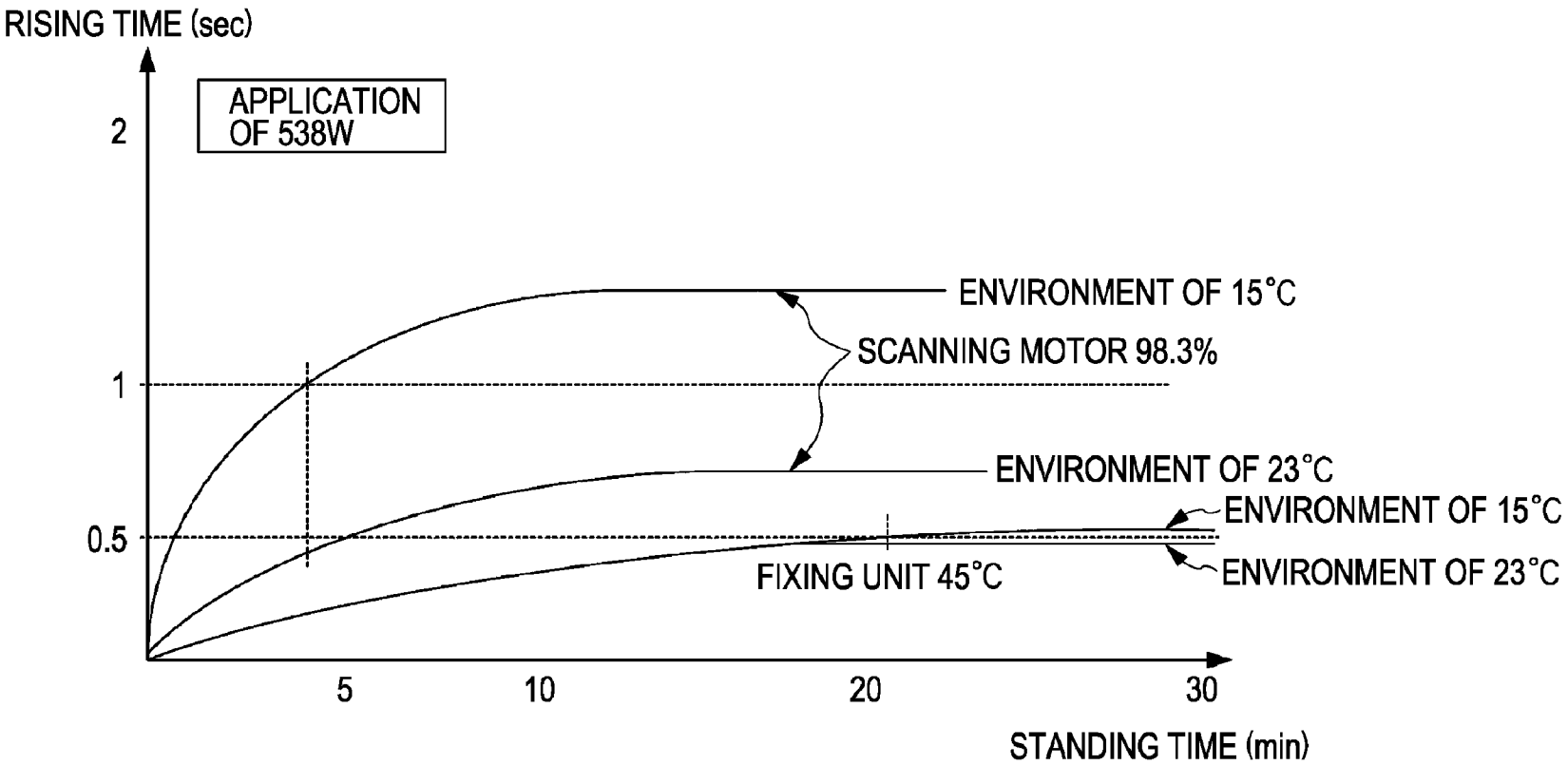
FIG. 11 is an illustration showing the relationship between a standing time after previous printing is completed and a time necessary for the scanning motor according to the first embodiment to reach the rotation speed of 98.3%, and the relationship between a standing time after the previous printing is completed and a time necessary for the fixing unit to reach 45° C., with respect to an environmental temperature.

FIG. 11 shows the relationship between a standing time after the previous printing is completed and a time that the scanning motor 30 used in the present embodiment reaches the rotation speed of 98.3%, with respect to an environmental temperature. Similarly, FIG. 11 shows the relationship between a standing time after the previous printing is completed and a time that the fixing unit 11 used in the present embodiment reaches 45° C., with respect to an environmental temperature. The rising characteristics of the fixing unit 11 shown in the graph are observed in a case where electric power at 538 W is applied to the heater 20. As described above, the scanning motor 30 used in the present embodiment requires 1 second or less so that the rotation speed of the scanning motor 30 reaches 98.3% regardless of the environmental temperature if the standing time is within about 4 minutes. The fixing unit 11 used in the present embodiment requires 0.5 seconds or less so that the temperature of the heater 20 reaches 45° C. regardless of the environmental temperature if the standing time is within about 20 minutes.

As described above, monitoring the rising state of the scanning motor 30 and the fixing unit 11 at the appropriate timing allows the environmental temperature, the voltage of the power supply, and the warm-up state of the fixing unit 11 to be determined to a certain degree. In the present embodiment, the appropriate start timing for conveying the recording medium to the transferring position is set by using the above-described conditions (number of condition disadvantageous for the fixability), thereby preventing the defective fixing from occurring, and shortening the printout time for the first sheet.

FIG. 12 is a table organizing exemplary statuses when printing is actually started. In the image forming apparatus according to the present embodiment, while electric power is applied to the scanning motor 30, and at the same time, to the heater 20 when the printing is started, the power-application timings of these may be slightly unsynchronized.

First, a case where the temperature of the heater 20 reaches 45° C. when 0.5 seconds elapse after the power application to the heater 20 is started will be described.

In this case, the standing time after the previous printing is completed is relatively short (about 20 minutes or less). Therefore, the fixing unit 11 is in a heat-holding state due to the previous printing, or the temperature of the heater 20 is 23° C. or more when the printing is started because the environmental temperature is normal temperature (23° C.) or more although the standing time is relatively long (about 20 minutes or more). Either case may be advantageous for securing the fixability. On the other hand, when the temperature of the heater 20 does not reach 45° C. when 0.5 seconds elapse after the power application to the heater 20 is started, the standing time after the previous printing is completed is relatively long and the environmental temperature is relatively low. This case may be disadvantageous for securing the fixability.

When the rotation speed of the scanning motor 30 is 98.3% or more when 1 second elapses after the power application to the scanning motor 30 is started, the standing time after the previous printing is completed is less than about 4 minutes, or the environmental temperature is normal temperature (23° C.) or more although the standing time is 4 minutes or more. Either case may be advantageous for securing the fixability. On the other hand, when the rotation speed of the scanning motor 30 is less than 98.3% when 1 second elapses after the power application to the scanning motor 30 is started, the standing time after the previous printing is completed is about 4 minutes or more, and the environmental temperature is low. This case may be disadvantageous for securing the fixability.

When the temperature of the heater 20 reaches 125° C. when 2 seconds elapse after the power application to the heater 20 is started, the voltage of the power supply is a normal voltage or more (power application to the heater 20 is at 500 W or more). This case may be advantageous for securing the fixability. On the other hand, when the temperature of the heater 20 does not reach 125° C. when 2 seconds elapse after the power application to the heater 20 is started, the voltage of the power supply is less than the normal voltage (power application to the heater 20 is at less than 500 W). This case may be disadvantageous for securing the fixability.

In the present embodiment, the paper-feeding-start timing is delayed as the condition disadvantageous for securing the fixability (condition number impossible to feed/convey paper) increases. In other words, paper feeding is started at an early timing as the number of condition disadvantageous for securing the fixability is small, to decrease the FPOT as much as possible.

With the fixing unit 11 according to the present embodiment, if the voltage of the power supply is the normal voltage or higher, and the environmental temperature is the normal temperature (23° C.) or more, even when the recording medium is fed from the paper cassette 7 when 2.5 seconds elapse after the power application to the heater 20 is started, the fixability may be sufficiently secured when the recording medium P reaches the fixing nip portion. Note that the voltage of the power supply of the normal voltage or higher means power application to the heater 20 at 500 W or higher.

By taking into account the above description, FIGS. 12 and 13 will be described. First, a status 1 is a state where the fixing unit 11 is in the heat-holding state due to the previous printing or the environmental temperature is the normal temperature or more, and the voltage of the power supply is the normal voltage or higher. Therefore, in the status 1, since the condition number impossible to feed/convey paper is zero, paper feeding is started when about 2.5 seconds elapse after a print signal is input.

A status 2 is a state where the fixing unit 11 is in the heat-holding state due to the previous printing or the environmental temperature is the normal temperature or more, and the voltage of the power supply is low. Therefore, in the status 2, since only the condition of the voltage of the power supply is disadvantageous for fixability, the condition number impossible to feed/convey paper is determined as 1. In this case, since the defective fixing possibly occurs if the paper feeding is started when 2.5 seconds elapse after the print signal is input, the paper feeding is started when the detected temperature of the thermistor 21 reaches (target temperature—20 degrees).

A status 3 is a state where the fixing unit 11 is in the heat-holding state due to the previous printing, the environmental temperature is low, and the voltage of the power supply is the normal voltage or higher. If the environmental temperature is relatively low, the recording paper is possibly cold, so that the status may be disadvantageous for securing the fixability. Therefore, in the status 3, since only the condition of the environmental temperature is disadvantageous for fixability, the condition number impossible to feed/convey paper is determined as 1. In this case, since the defective fixing possibly occurs if the paper feeding is started when 2.5 seconds elapse after the print signal is input, the paper feeding is started when the detected temperature of the thermistor 21 reaches (target temperature—20 degrees).

A status 4 is a state where the fixing unit 11 is in the heat-holding state due to the previous printing, the environmental temperature is low, and the voltage of the power supply is low. Therefore, in the status 4, since the two conditions of the environmental temperature and the voltage of the power supply are disadvantageous for fixability, the condition number impossible to feed/convey paper is determined as 2. In this case, since the defective fixing possibly occurs if the paper feeding is started when the detected temperature of the thermistor 21 reaches (target temperature—20 degrees), the paper feeding is started when the detected temperature of the thermistor 21 reaches (target temperature—10 degrees).

Next, statuses 5 and 6 will be described. In the statuses 5 and 6, the detected result of the thermistor 21 when 0.5 seconds elapse after the power application is started corresponds to low-temperature environment, however, the detected result of the scanning motor 30 when 1 second elapses after the power application is started is the environment at the normal-temperature or more. These two detected results may be considered as contradiction, however, here is the reason as follow. When the location of the printer is near an air conditioning in the room, cooling air from the air conditioning may directly blow the printer. Since the scanning motor 30 is generally housed in the optical box in an almost sealed manner, the cooling air hardly blows the scanning motor 30. However, if a cooling louver is provided near a fixing unit housing of the printer, the cooling air of the air conditioning may enter through slits of the cooling louver to cool the fixing unit 11. Accordingly, the fixing unit 11 may be cooled to be the room temperature or less, while the scanning motor 30 would not be cooled relative to the fixing unit 11 because the scanning motor 30 is disposed in the optical box. Hence, the contradicted detected results as in the status 5 and 6 may appear. The statuses 5 and 6 are limited, but may actually exist. The status 5 is a state where the voltage of the power supply is the normal voltage or higher, the condition number impossible to feed/convey paper is determined as 1. In this case, since the defective fixing possibly occurs if the paper feeding is started when 2.5 seconds elapse after the print signal is input, the paper feeding is started when the detected temperature of the thermistor 21 reaches (target temperature—20 degrees). The status 6 is a state where the voltage of the power supply is low, the condition number impossible to feed/convey paper is determined as 2. In this case, since the defective fixing possibly occurs if the paper feeding is started when the detected temperature of the thermistor 21 reaches (target temperature—20 degrees), the paper feeding is started when the detected temperature of the thermistor 21 reaches (target temperature—10 degrees).

A status 7 is a state where the fixing unit 11 is cold, the environmental temperature is low, and the voltage of the power supply is the normal voltage or higher. Therefore, the condition number impossible to feed/convey paper is determined as 2. In this case, since the defective fixing possibly occurs if the paper feeding is started when the detected temperature of the thermistor 21 reaches (target temperature—20 degrees), the paper feeding is started when the detected temperature of the thermistor 21 reaches (target temperature—10 degrees).

A status 8 is a state where the fixing unit 11 is cold, the environmental temperature is low, and the voltage of the power supply is low. This status is necessary to wait until the fixing unit 11 is sufficiently heated. The condition number impossible to feed/convey paper of the status 8 is determined as 3. Since the defective fixing possibly occurs if the paper feeding is started when the detected temperature of the thermistor 21 reaches (target temperature—10 degrees), the paper feeding is started when the detected temperature of the thermistor 21 reaches the target temperature.

Figures 5, 5A:
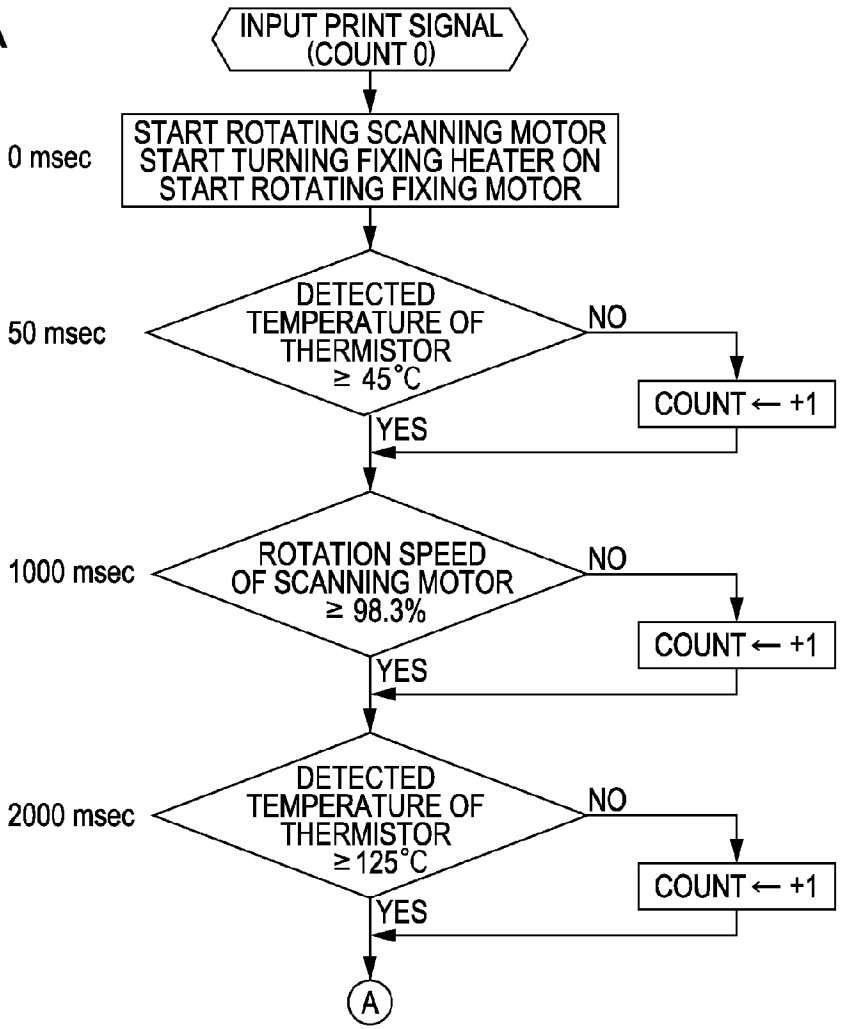
FIG. 5 is a flowchart showing procedures for determining a start timing for conveying the recording medium for the image forming apparatus according to the first embodiment.
Figure 5B:
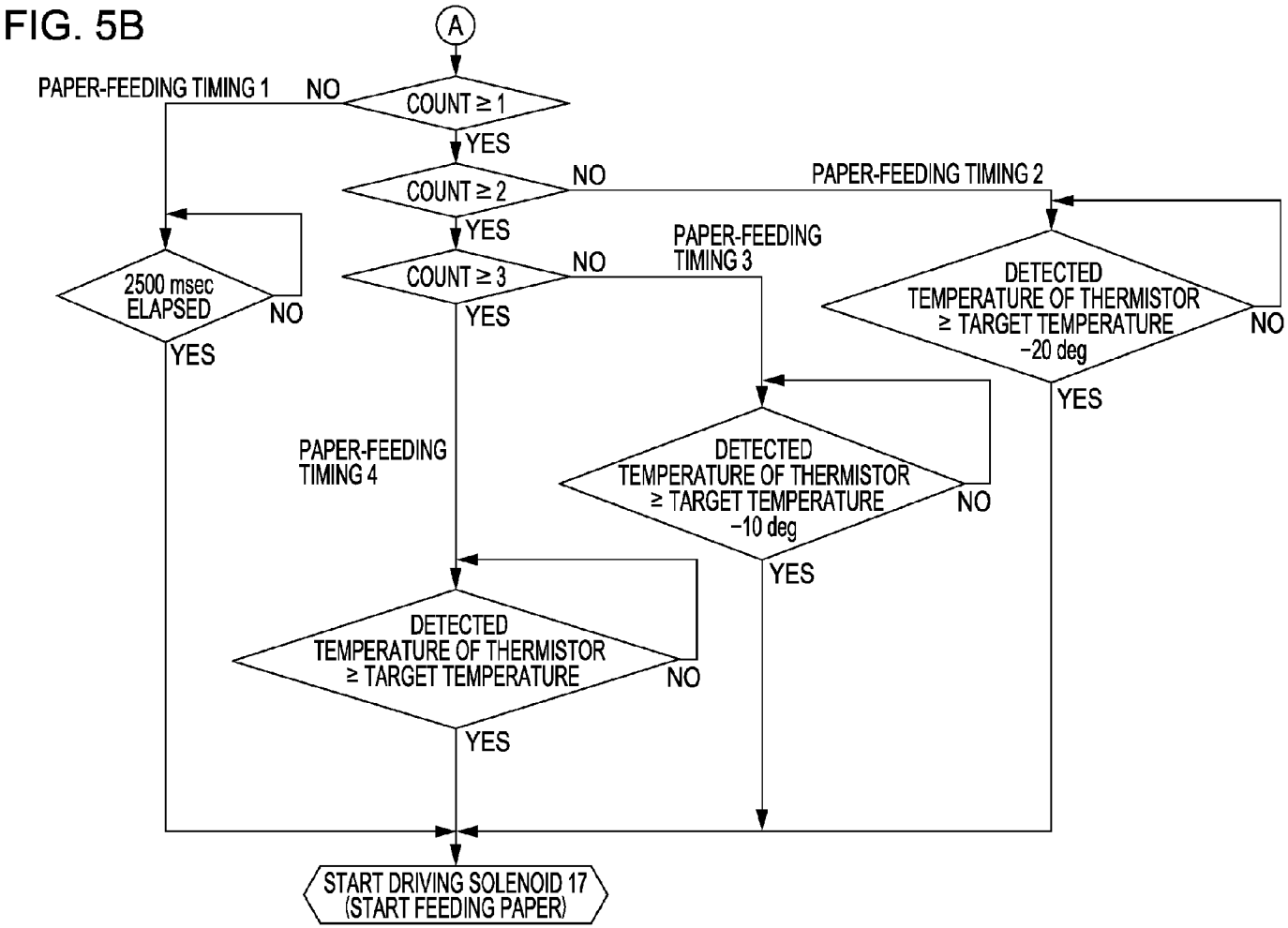
Figure 6:
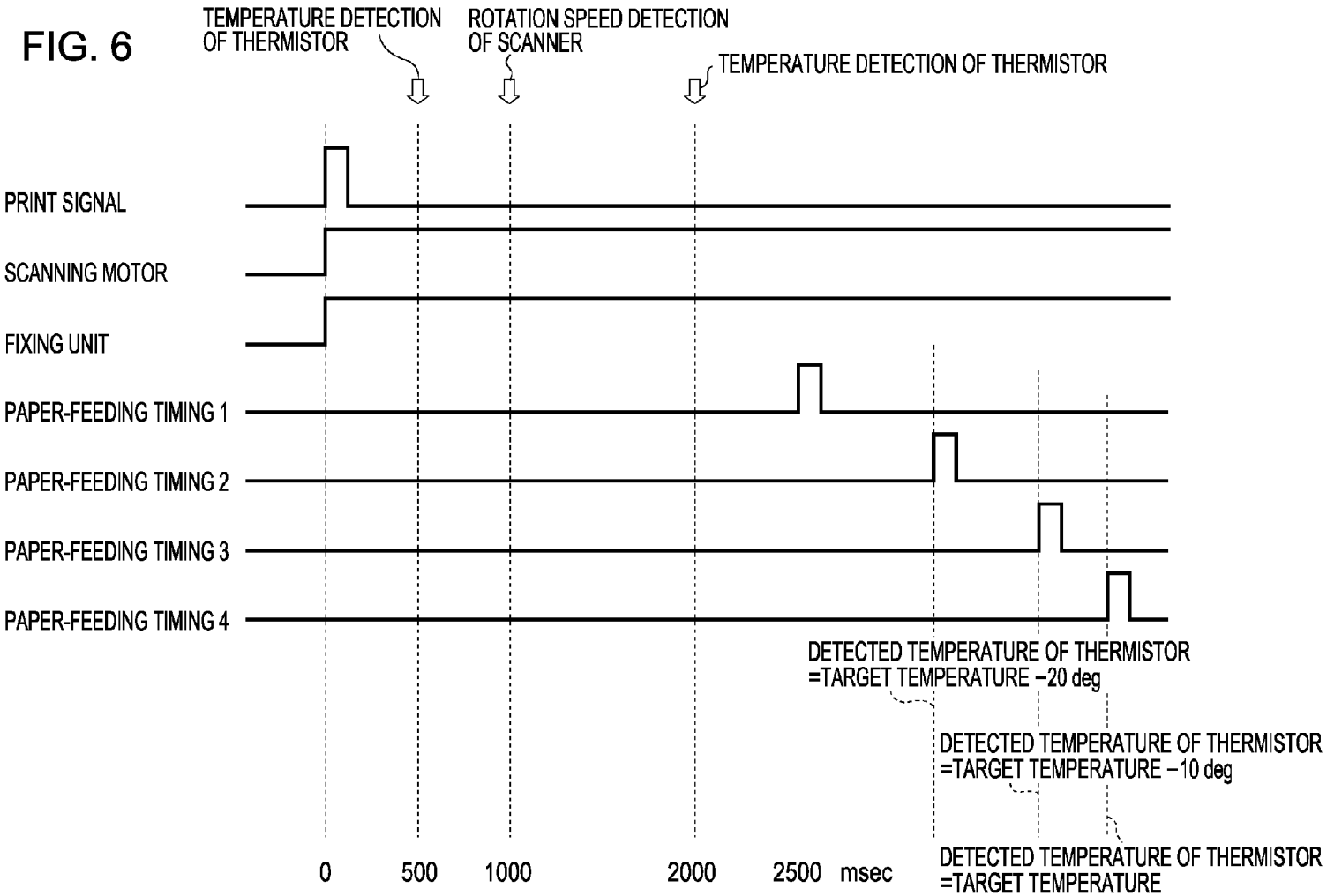
FIG. 6 is a time chart showing the start timing for conveying the recording medium for the image forming apparatus according to the first embodiment.

Summarizing the above-described statuses, the printer according to the present embodiment operates as shown in a flowchart of FIG. 5 and as shown in a time chart of FIG. 6. As shown in FIGS. 5 and 6, in the status 1, the paper feeding is performed at a paper-feeding timing 1. In the statuses 2, 3 and 5, the paper feeding is performed at a paper-feeding timing 2. In the statuses 4, 6 and 7, the paper feeding is performed at a paper-feeding timing 3. In the status 8, the paper feeding is performed at a paper-feeding timing 4.

Figure 14:
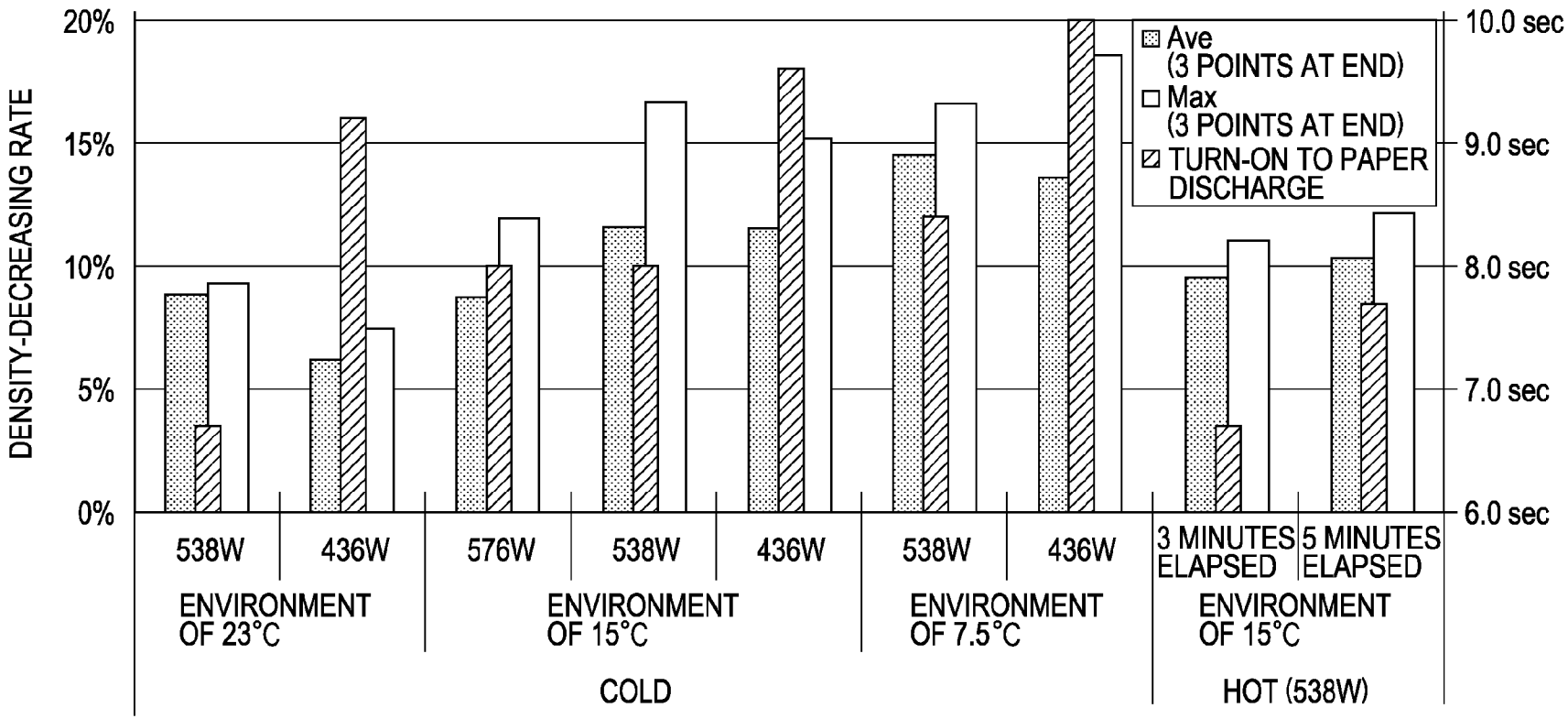
FIG. 14 is a graph showing fixability and FPOT in various statuses in which a warm-up state of the fixing unit, the environmental temperature, and the voltage state of the power supply vary.

FIG. 14 is a graph showing the fixability and the FPOT in the various statuses in which the warm-up state of the fixing unit 11 (heat-holding state due to the previous printing), the environmental temperature, and the voltage of the power supply vary. Three indices belonging to the horizontal axis are electric power input to the heater 20 (which may vary according to a variation in the voltage of the power supply), the environmental temperature, and the warm-up state of the fixing unit 11 (the heat-holding state), sequentially ordered from the upper side. "COLD" of the warm-up state of the fixing unit 11 indicates that an elapsed time after the previous printing is completed is sufficiently long (20 minutes or more), and "HOT" indicates that an elapsed time is relatively short (less than 20 minutes). In addition, two sets of bars at the right side of the graph indicate values when the elapsed times after the previous printing is completed are 3 and 5 minutes, respectively, at 15° C. as the environmental temperature, and at 538 W as the electric power input to the heater 20.

To determine the fixability, three points at an end in the conveying direction of the output recording sheet are rubbed, and difference between the density before the rubbing and that after the rubbing (density-decreasing rate) is checked. The vertical axis at the left side of the drawing indicates a scale for the density-decreasing rate. In the graph, an average value (Ave) and a maximum value (Max) of the density-decreasing rate are shown. If the density-decreasing rate is less than 20%, it is determined that the fixability is reliably maintained.

As shown in this graph, the density-decreasing rate is less than 20% in any status. In addition, the vertical axis at the right side of the drawing indicates a scale for a time between input of the print signal and output of the recording sheet. As shown in the drawing, more the conditions for securing the reliable fixability are given, faster the paper-feeding timing becomes, thereby providing shorter FPOT.

In addition, if the elapsed time is about 3 minutes in the HOT state (where the elapsed time after the previous printing is completed is less than 20 minutes), the heat-holding amount of the fixing unit 11 is extremely large. In this case, even if the environmental temperature is relatively low, the reliable fixability may be secured (only when the voltage of the power supply is normal voltage or higher). In the present embodiment, if the elapsed time is about 3 minutes, as shown in FIG. 11, the scanning motor 30 has a temperature not as low as the environmental temperature. Even in the low-temperature environment, the detected rotation speed when 1 second elapses after the print signal is input is 98.3% or more. Therefore, as shown in the graph of FIG. 14, the FPOT after 3 minutes elapse is extremely short even in the low-temperature environment. Hence, the FPOT may be short with conditions that the fixability is sufficiently secured such as when the elapsed time is 3 minutes. In contrast, when the elapsed time is 5 minutes, the determination on the environmental temperature by way of the detection of the rotation speed of the scanning motor 30 becomes accurate, so that the FPOT is long for the determination. In this case, the heat-holding amount of the fixing unit 11 decreases as compared with the case where the elapsed time is 3 minutes. The FPOT, therefore, is appropriate for reliably securing the fixability.

As described above, according to the present embodiment, the paper-feeding timing can be appropriately set while the fixability can be reliably secured.

Second Embodiment

According to a second embodiment, resistance information of a transfer roller 50 is monitored in addition to the rotation information of the scanning motor 30, and the temperature information of the fixing unit 11 (temperature information of the heater 20). The configuration of the second embodiment is similar to that of the first embodiment except for information which is monitored to determine the paper-feeding timing, and a paper-feeding timing when the condition number impossible to feed/convey paper is zero.

Figure 15:
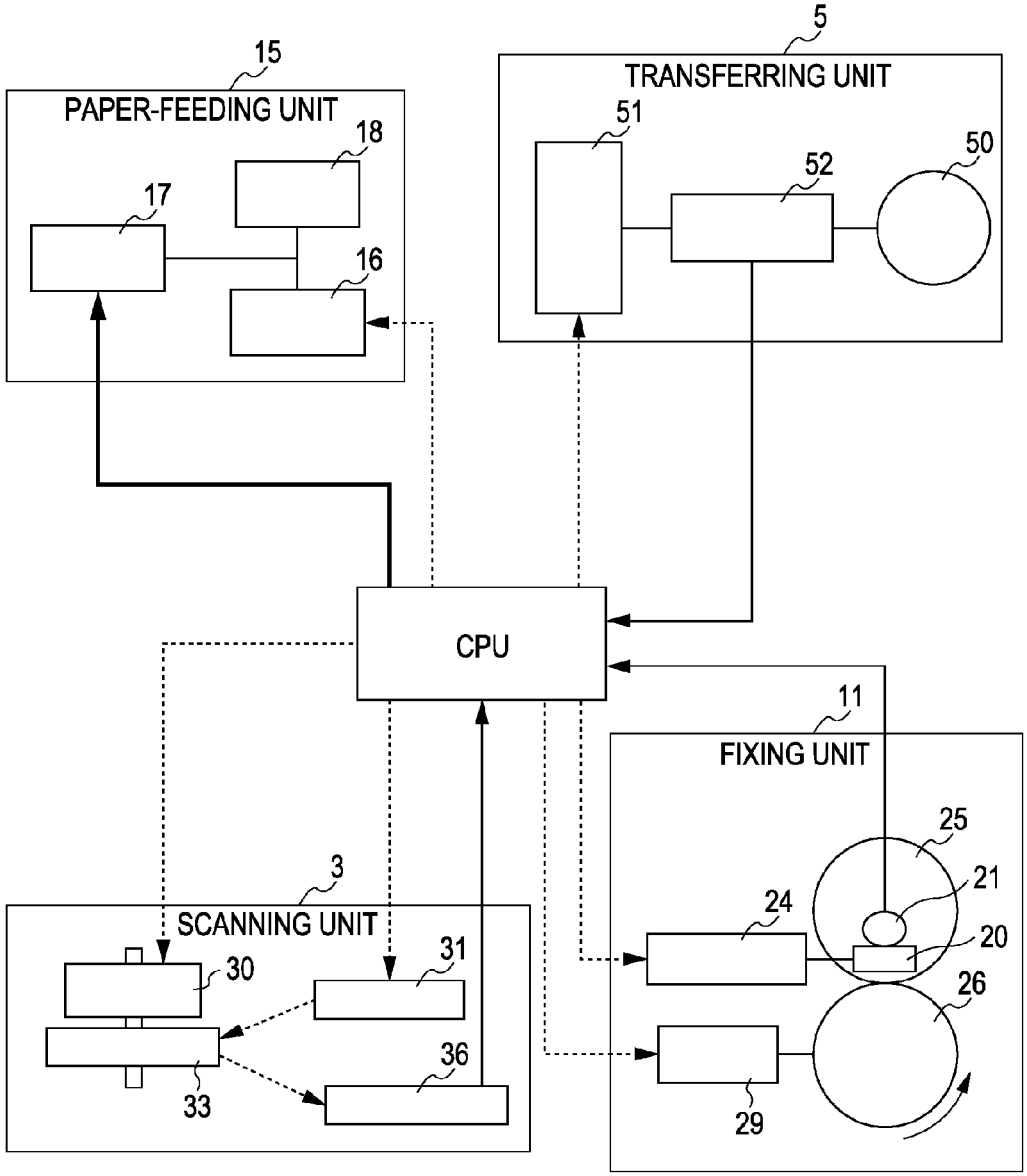
FIG. 15 is a block diagram showing the relationship among a paper-feeding unit, a transferring unit, a scanning unit, and a fixing unit of an image forming apparatus according to a second embodiment.

FIG. 15 is a block diagram according to the present embodiment. In the present embodiment, a resistance of the transfer roller 50 is monitored as described above, and obtained information is used for determining the paper-feeding timing. Reference numeral 51 denotes a direct-current-high-voltage generator, and 52 denotes a current-voltage detector.

The CPU sends a command to the direct-current-high-voltage generator 51 as shown by a broken line, and direct-current-high-voltage generator 51 applies a transfer bias to the transfer roller 50 through the current-voltage detector 52. The current-voltage detector 52 sends resistance information of the transfer roller 50 back to the CPU, so that the CPU may obtain an ambient humidity based on the information.

The transfer roller 50 to which the transfer bias is applied for transferring a toner image includes a cored bar 5*a* made of Fe, SUS, or the like, and an elastic layer 5*b* provided around the cored bar 5*a* and made of electrically-conductive rubber, electrically-conductive sponge, or the like. The elastic layer 5*b* is adjusted to have a resistance about $10^6$ to $10^{10}$ Ω by adding carbon or the like thereto.

The resistance of the elastic layer 5*b* of the transfer roller 50 varies on account of its environment. For example, the resistance of the elastic layer 5*b* becomes about $2.5\times10^7$ to $8\times10^7$ Ω in H/H environment, about $1\times10^8$ to $3\times10^8$ Ω in N/N environment, and about $4\times10^8$ to $1.2\times10^9$ Ω in L/L environment. The H/H environment means high-temperature and high-humidity environment, for instance, 33° C./80%. The N/N environment means normal-temperature and normal-humidity environment, for instance, 23° C./60%. The L/L environment means low-temperature and low-humidity environment, for instance, 15° C./10%.

Figures 16, 16A:
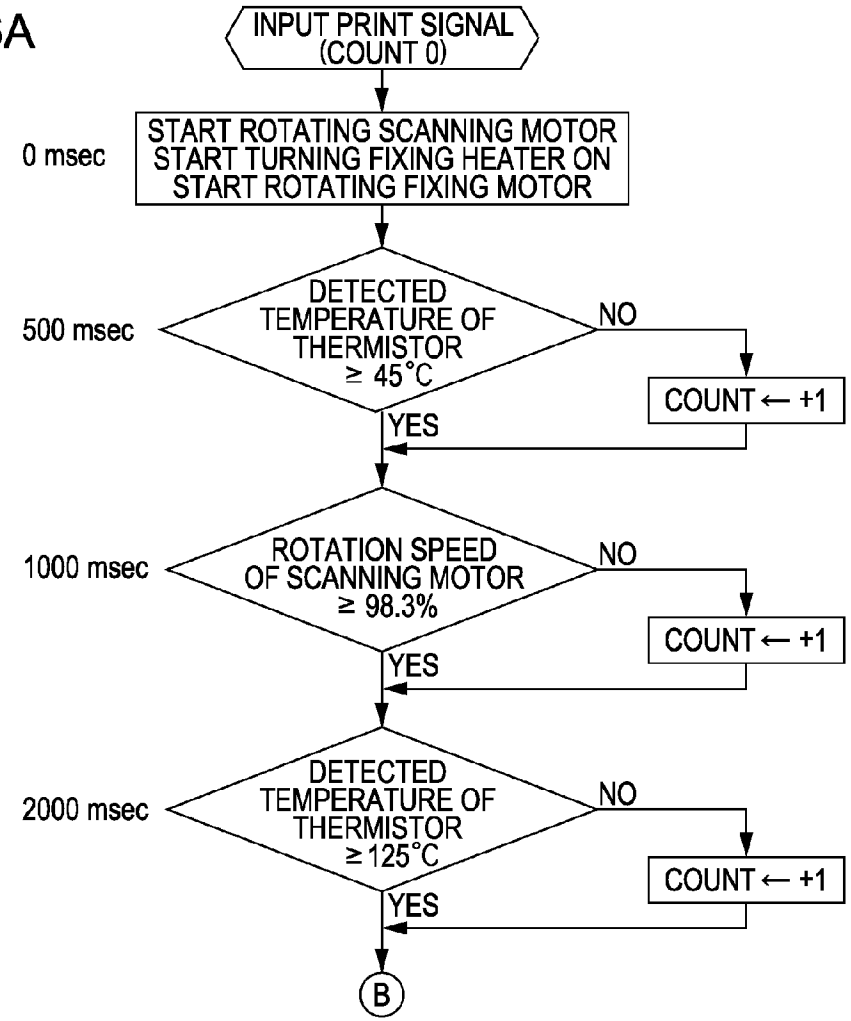
FIG. 16 is a flowchart showing procedures for determining a start timing for conveying the recording medium for the image forming apparatus according to the second embodiment.
Figure 16B:
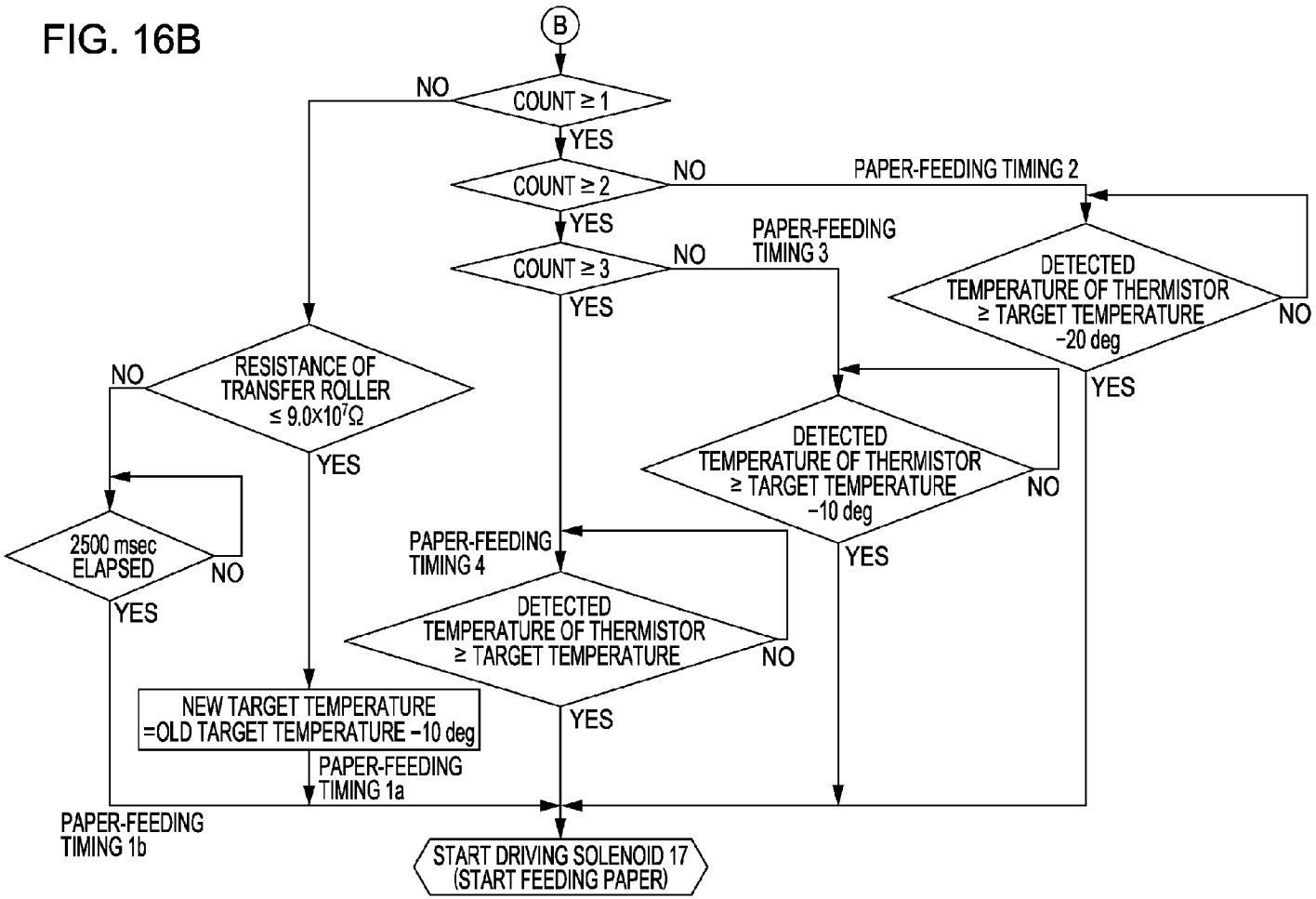
Figure 17:
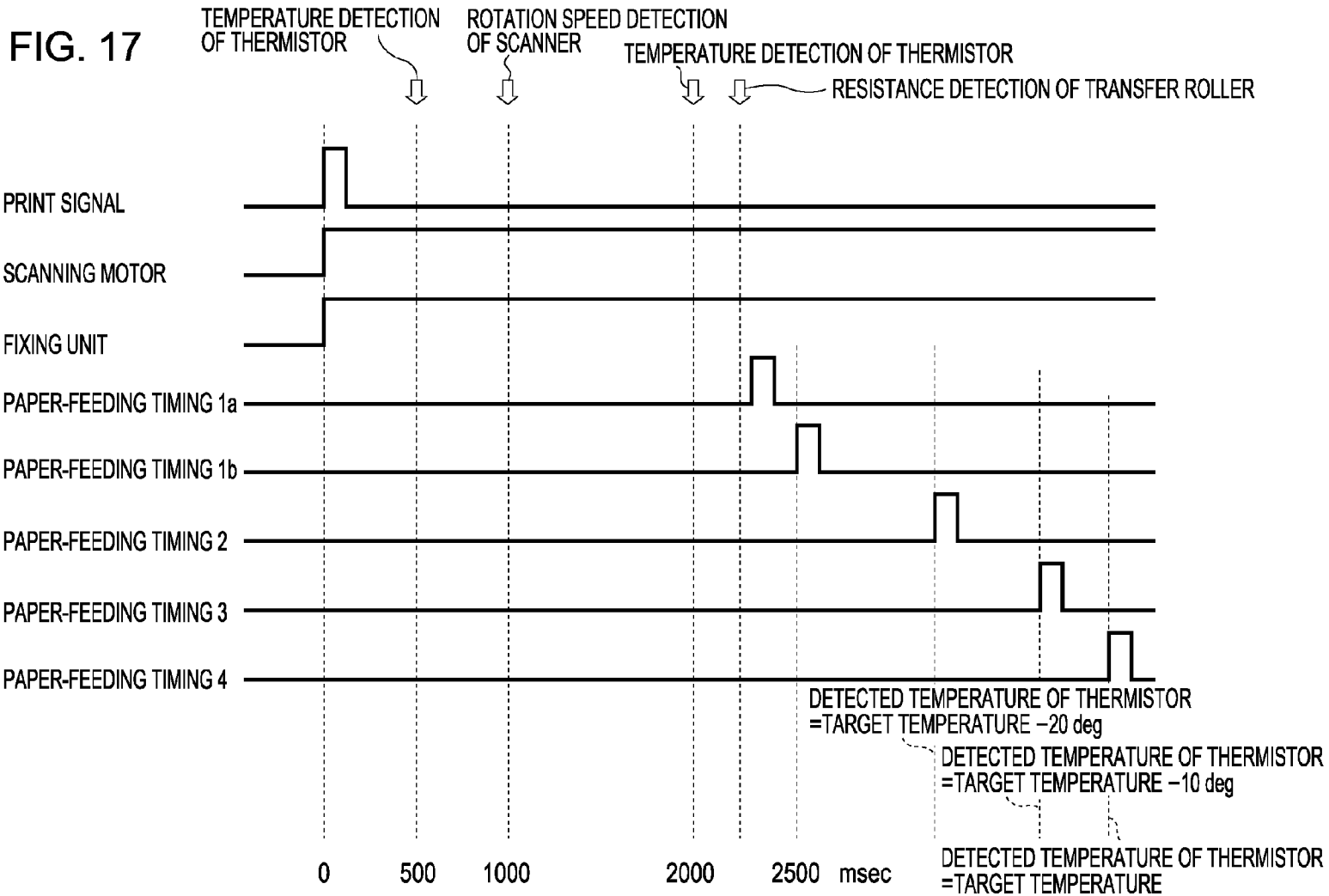
FIG. 17 is a time chart showing the start timing for conveying the recording medium for the image forming apparatus according to the second embodiment.

Then, procedures of the present embodiment will be described referring to FIG. 16. In the second embodiment, procedures until the condition number impossible to feed/convey paper is counted are similar to that of the first embodiment, but a paper-feeding timing when the count is zero is different from that of the first embodiment. When the condition number impossible to feed/convey paper is zero, the resistance of the transfer roller 50 is monitored. When the resistance of the transfer roller 50 is $9\times10^7$ Ω or less, namely, when the state is determined as the H/H environment (33° C./80%), the paper feeding is started immediately without waiting for the elapsed time of 2.5 seconds after the print signal is input. In the high-temperature environment, the fixability is sufficient even when the fixing target temperature is 10 degrees less than as it is. Accordingly, the fixing target temperature may decrease by 10 degrees, and the fixability may be secured even if the sheet is immediately fed. FIG. 17 shows a time chart according to the present embodiment.

With this embodiment, FPOT in the high-temperature and high-humidity environment may further decrease.

While the fixing unit 11 using the ceramic heater 20 is described in the above-described first and second embodiments, a fixing unit of a heat roller type in which a halogen lamp is embedded in a fixing roller, or a fixing unit employing the theory of electromagnetic induction may be used.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-297599 filed Oct. 12, 2005, which is hereby incorporated by reference herein in its entirety.

What is claimed is:

1. An image forming apparatus comprising:

a photosensitive member;

a laser scanner that scans the photosensitive member with laser beam in accordance with image information, the laser scanner having a motor to which a rotating mirror that deflects the laser beam is attached;

a transferring unit that transfers a toner image formed on the photosensitive member on a recording medium at a transferring position;

a fixing unit that heats and fixes the toner image transferred on the recording medium; and a conveyance controller that controls conveyance of the recording medium, wherein the conveyance controller determines a start timing for conveying the recording medium to the transferring position in accordance with a warm-up state of the fixing unit, a voltage state of a power supply, and an environmental temperature, at a time when the toner image is started to be formed on the photosensitive member, wherein as a number of condition disadvantageous for fixability, among three conditions including the warm-up state of the fixing unit, the voltage state of the power supply, and the environmental temperature, increases, the conveyance controller is configured to increase delay of the start timing for conveying the recording medium, and wherein the conveyance controller starts conveying the recording medium based on a detected temperature detected by a detecting element that detects a temperature of the fixing unit if there is at least one condition disadvantageous for the fixability among the three conditions, or starts conveying the recording medium when a predetermined time elapses after a print signal is input if there is no condition disadvantageous for the fixability.

2. The image forming apparatus according to claim 1, wherein the transferring unit has a transfer member that comes into contact with the photosensitive member, and the conveyance controller starts conveying the recording medium regardless of the predetermined time if there is no condition disadvantageous for the fixability and a resistance of the transfer member is less than a predetermined value.

3. The image forming apparatus according to claim 1, wherein the warm-up state of the fixing unit is determined according to a temperature-increasing state of the fixing unit at a first timing that comes after a print signal is input, the voltage state of the power supply is determined according to a temperature-increasing state of the fixing unit at a second timing that comes after the first timing, and the environmental temperature is determined according to a rotation state of the motor of the laser scanner.

4. The image forming apparatus according to claim 3, wherein the fixing unit has a rotating body that conveys the recording medium, and the first timing is set within a time between that the rotating body starts rotating and that the rotating body rotates one turn.

5. A method for determining a start timing for conveying a recording medium to a transferring position where a toner image formed on a photosensitive member is transferred on the recording medium, comprising:

determining a warm-up state of a fixing unit for fixing the toner image on the recording medium at a time when the toner image is started to be formed on the photosensitive member;

determining a voltage state of a power supply for supplying an electric energy to the fixing unit at a time when the toner image is started to be formed on the photosensitive member;

determining an environmental temperature at a time when the toner image is started to be formed on the photosensitive member; and determining a start timing for conveying the recording medium to the transferring position based on the warm-up state of the fixing unit, the voltage state of the power supply, and the environmental temperature, wherein the warm-up state of the fixing unit is determined according to a temperature-increasing state of the fixing unit at a first timing that comes after a print signal is input, the voltage state of the power supply is determined according to a temperature-increasing state of the fixing unit at a second timing that comes after the first timing, and the environmental temperature is determined according to a rotation state of a motor of a scanner.

6. The method according to claim 5, wherein the start timing for conveying the recording medium is delayed as a number of condition disadvantageous for fixability among three conditions including the warm-up state of the fixing unit, the voltage state of the power supply, and the environmental temperature increases.

7. The method according to claim 5, further comprising determining a resistance of a transfer member of a transferring unit that makes contact with the photosensitive member, wherein the start timing for conveying the recording medium is determined based on the warm-up state of the fixing unit, the voltage state of the power supply, the environmental temperature, and the resistance of the transfer member.

* * * * *